United States Patent [19]

Le Monnier de Gouville et al.

[11] Patent Number: 4,773,383

[45] Date of Patent: Sep. 27, 1988

[54] GAS BURNER ADAPTED FOR THE USE OF SEVERAL TYPES OF GAS

[75] Inventors: Jean-Bernard Le Monnier de Gouville; Bernard Dané, both of Veigne, France

[73] Assignee: Sourdillon-Airindex, Veigne, France

[21] Appl. No.: 48,299

[22] Filed: May 11, 1987

[30] Foreign Application Priority Data

May 12, 1986 [FR] France ..... 86 06755

[51] Int. Cl.[4] ..... F24C 3/00

[52] U.S. Cl. ..... 26/39 R; 126/39 K; 239/553.3; 431/354

[58] Field of Search ..... 126/39 R, 39 H, 39 N, 126/39 K; 239/553.3, 567, 390, 396; 431/354

[56] References Cited

U.S. PATENT DOCUMENTS 4,690,636 9/1987 Le Monnier de Gouville ... 431/354

FOREIGN PATENT DOCUMENTS 500724 2/1951 Belgium ..... 239/553.3

535521 2/1955 Belgium ..... 239/396

*Primary Examiner*—Carroll B. Dority, Jr.

*Attorney, Agent, or Firm*—Larson & Taylor

[57] ABSTRACT

Gas burner arranged to operate with several types of gas, comprising a burner body equipped with an air inflow regulator ring which is a cylinder of revolution with an air inlet in its cylindrical side wall. The two end surfaces are provided respectively with two coaxial apertures for the outflow of the gas mixture of different diameters. This ring and its mounting emplacement in the body are such that it can be positioned in one or the other of two possible positions, with the aperture of largest diameter or of smallest diameter facing the gas nozzle accordingly as the gas is respectively a liquified petroleum or a manufactured or natural gas.

8 Claims, 1 Drawing Sheet

GAS BURNER ADAPTED FOR THE USE OF SEVERAL TYPES OF GAS

BACKGROUND OF THE INVENTION

The present invention relates generally to improvements in or to gas burners, particularly for domestic appliances such as cookers or the like.

More specifically, the invention relates to an improved arrangement for a gas burner, particularly for a domestic appliance such as a cooker or the like, adapted to operate with several types of gas. The gas burner comprises a burner body equipped with a regulator ring for the air flow rate, which body is designed to be positioned coaxially to a gas nozzle mounted at the end of a gas inlet pipe. This ring is in the general shape of a cylinder of revolution and comprises at least one air inlet aperture formed in its cylindrical side wall and an outlet aperture for the inflammable air/gas mixture formed coaxially in one end surface.

Certain types of gas burners are arranged to operate with different types of gas belonging to three broad families of gases currently used in the domestic field, namely: manufactured gases (gases of the first family), natural gases (gases of the second family) and liquified petroleum gases (gases of the third family). The adaptation of the burner to operation with any one of these gases is effected by equipping it with a corresponding gas nozzle and by adjusting the flow rate of primary air with which the gas is mixed to constitute the fuel mixture, by means of an adjustable air regulator ring.

However, the solutions adopted for these known burners, although already simplifying the general design of burners and the holdings of stocks of spare parts, still proves to be complicated. Therefore, it has appeared desirable to produce a still simpler burner construction which permits an adaptation which is easy, rapid and without lengthy and expensive dismounting and reassembly of parts.

GENERAL DESCRIPTION OF THE INVENTION

The principle of the invention resides in the experimental observation that the correct operation of a multigas burner using gases belonging to the three above-indicated families could be achieved with only two different values of the diameter of the neck of the venturi with which the burner is equipped. One of these diameters is very suitable both for manufactured gases of the first family and for natural gases of the second family, whilst the other diameter is suitable for only liquified petroleum gases of the third family.

Under these conditions, and for the above-mentioned purposes, a gas burner arranged according to the invention is characterized in that the two end surfaces of the air regulator ring are provided respectively with two coaxial apertures of different diameters. The aperture of smallest diameter is dimensioned appropriately to the operation of the burner with a manufactured gas or a natural gas and the aperture of largest diameter being dimensioned appropriately for operation of the burner with a liquified petroleum gas. This ring and the position of the mounting of the latter in the body of the burner are arranged so that the ring can be placed in position selectively in one or other of two possible positions, namely with the aperture of largest diameter or the aperture of smallest diameter facing the gas nozzle, according to the gas type used.

In a simple embodiment, the inner diameter of the ring corresponds substantially to the diameter of its aperture having the largest diameter.

In an advantageous embodiment which avoids disturbances being introduced into the primary air flow, the ring comprises several air intake apertures of which the total surface area represents the major portion of the surface of the cylindrical side wall. In this side wall, there only subsist several strips of material distributed circumferentially which join the end surfaces. In addition, the body of the burner is arranged in the form of a cup or cylindrical gas inlet passage coaxial with the gas nozzle and designed to receive said air regulator ring. The side wall of this cup or gas inlet passage is provided with apertures defining pillars between them. The angular positioning of the ring in this cup is such that the apertures and the axial strips of material of the ring are substantially in coincidence with the apertures and the pillars of the cup.

To simplify the assembly of the burner and the appropriate positioning of the ring in the burner body, the burner body is advantageously provided with single means ensuring simultaneously the predetermined angular positioning and the axial retention of the ring. Preferably, said means of angular positioning and axial retention comprises a screw fixed in the burner body close to the edge of the cup whose head, extending into the cup, co-operates with a notch formed in the air regulator ring. The ring can then have two notches adapted to be engaged by the locking screw when the ring is respectively in its two possible operating positions.

In the particular case where the burner is of a flat type comprising a burner body provided with an inlet passage for gas fuel mixture which is axial, vertical and a cylinder of revolution and shields a gas nozzle, and a cap covering the burner body and resting on the latter by means of an annular crown provided with flame orifices distributed circumferentially, the annular surface of the burner body bordering the mouth of the inlet passage of the gas mixture and the opposite surface of the cap are frustoconical to define an annular convergent-divergent system extending approximately transversely to the gas jet. The burner body and the annular crown define in addition, between their opposite surfaces, an annular decompression chamber situated between the abovesaid convergent-divergent system and the flame orifices. It is desirable, in order that the flow of primary air should not be disturbed by the presence of the regulator ring, for the end surfaces of the air regulator ring to be themselves frustoconical with a cone angle corresponding approximately to that of the frustoconic annular surface of the burner body so that each end surface extends approximately radially inwards of said annular surface of the burner body.

Finally, to ensure stable and always identical axial positioning of the ring in its receiver cup or gas inlet passage, and so that its upper end surface may always be situated in approximate extension of the frustoconic annular surface of the burner body, it may be advantageous for the bottom of the passage or cup of the burner body receiving the air regulator ring to be also frustoconical with a shape complementary to the shape of the end surfaces of the ring.

Finally, by means of the arrangements provided according to the invention, the suiting of the gas burner to operation with any one of the gases customarily used is effected by positioning only a single ring in one direction or in the other, without adjustment and without replacement of parts.

The invention will be better understood on reading the following detailed description of one of its preferred embodiments given purely by way of illustration. In this description reference is made to the accompanying drawings.

Figure 1:
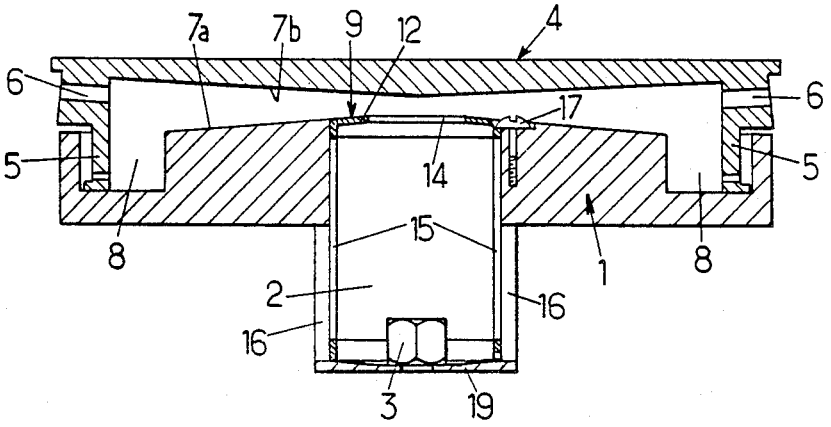
FIG. 1 is a diagrammatic view in diametric cross-section of a gas burner arranged according to the invention, shown in a first functional arrangement.
Figure 2:
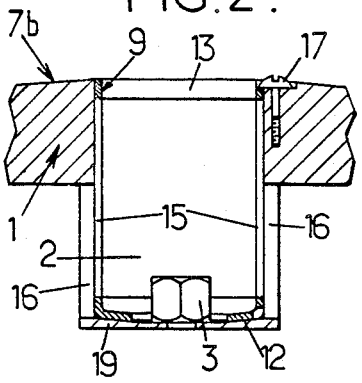
FIG. 2 is a partial diagrammatic view in diametric cross-section of the embodiment of the burner of FIG. 1 shown in another functional arrangement.

As will emerge from the foregoing, the invention relates to all types of gas burners adapted to use any type of gas of one of the three aforementioned families. The gas burner which will now be described below by way of example and which is shown in FIGS. 1 and 2 is a flat type burner, such as those which equip particularly cooker plates.

DESCRIPTION OF A PREFERRED EMBODIMENT

This type of burner comprises a burner body 1 provided with an axial gas inlet passage 2 which is vertical and a cylinder of revolution. Body 1 shields a gas nozzle 3. A cap 4 covers the burner body 1 and rests on the latter by means of an annular crown 5 provided with flame orifices 6 distributed circumferentially. The annular surface *7a* of the burner body 1 bordering the mouth of the inlet passage 2 for the gas mixture and the facing surface *7b* of the cap 4 are frustoconic to define an annular convergent-divergent system extending approximately transversely to the gas jet. The burner body 1 and the annular crown 5 define in addition, between their opposite surfaces, an annular decompression chamber 8 situated between the abovesaid convergent-divergent system and the flame orifices 6.

Figure 3:
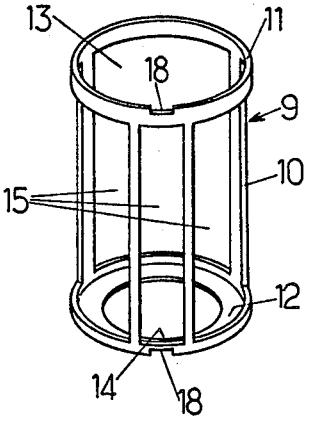
FIG. 3 is a perspective view of an air regulator ring arranged according to the invention and forming part of the constitution of the burner of FIGS. 1 and 2.

In the gas inlet passage 2, which then plays the part of a receiver cup, there is positioned an air regulator ring 9 which, as seen in FIG. 3, has the general shape of a cylinder of revolution. Ring 9 has a cylindrical side wall 10 and end surfaces 11 and 12 provided with orifices 13 and 14 respectively of different diameters. More specifically, in the ring 9 which is shown, the diameter of the orifice 13 corresponds to the internal diameter of the ring 9 and no lip is provided at end surface 11. The orifice 13 (which is the orifice of largest diameter) is dimensioned for the correct operation of the burner with liquified petroleum gases. On the other hand, the orifice 14 has a lip at end surface 12 and is thus of smaller diameter and suitable for the operation of the burner with manufactured or natural gases.

The side wall 10 of the ring is pierced by primary air entry apertures 15 whose number and size are such that in fact the wall 10 is reduced to several strips of material distributed circumferentially and connecting the end surfaces. For the same purpose and correspondingly, the wall of the gas inlet passage 2 is formed with apertures 16 which define between them "pillars" of material, identical in number and in circumferential distribution with those of the ring 9.

Finally, a screw 17 is fixed in the annular surface *7a* of the burner body 1 in the vicinity of the periphery of the passage 2 so that the head of this screw 17 projects into this passage. Thus, screw 17 co-operates with notches 18 provided in the ring 9 at the junction of the side wall 10 and the end surfaces 11 and 12. The ring 9 is then held axially in the passage 2 and is blocked in rotation so that the strips of material separating the apertures 15 of the primary air passage of the ring are substantially in coincidence with the "pillars" of material separating the apertures 16 of the primary air passage of the burner body 1. This is done in order that the flow of primary air should not be disturbed by an offset angular positioning of the ring with respect to the passage 2.

On this subject, it will also be noted that the height of the ring 9 is substantially identical with the depth of the passage 2, so that the end surface 11 or 12 of the ring is flush with the frustoconic annular surface *7a*. In order not to disturb the flow of the fuel gas mixture at the outlet of the ring 9, the end surfaces of the latter (face 12 in FIG. 1) are not flat but are frustoconic with a conicity corresponding approximately with that of the annular surface 7 in order to extend the latter radially inwards.

Finally, to ensure a stable positioning of the ring in the passage 2 and to ensure that the upper end surface is substantially in extension of the annular surface *7a*, the bottom 19 of the passage 2 which supports the gas nozzle 3 is, towards the inside of the passage 2, arranged also with a frustoconic surface of shape complementary with the shape of the end surfaces of the ring.

The adaptation of the burner to operate with gases of the first or second families or of the third family is done simply by inverting the ring in its position, after unlocking the screw 17.

As is self-evident and as emerges already besides from the foregoing, the invention is in no way limited to those of its types of application and embodiment which have been more particularly envisaged; it encompasses thereof, on the contrary, all modifications.

We claim:

1. A gas burner, particularly for a domestic appliance such as a cooker or the like having a gas nozzle issuing a gas jet, which gas burner is adpated to operate with several types of gas comprising:

a burner body including an air inlet passage;

a regulator ring which regulates an air/gas flow and defining;

(a) a cylindrical side wall, (b) two end surfaces, (c) at least one air inlet aperture in said cylindrical side wall, (d) a first outlet aperture in one said end surfaces having a first diameter dimensioned for operation with a liquefied petroleum gas, and (e) a second outlet aperture in the other end surfaces having a second diameter smaller than the first diameter of said first outlet aperture and dimensioned for operation with a manufactured gas and with a natural gas; and a mounting means for invertibly mounting said regulator ring in said burner body with the gas nozzle disposed for issuing the gas jet into said ring toward a facing one of said first and second outlet apertures and for drawing air therein through said air inlet passage in said burner body and said air inlet aperture in said regulator ring to form a gas-/air mixture whereby said ring is selectively positionable with said first outlet aperture as the facing aperture when the gas is liquefied petroleum and with said second outlet aperture as the facing aperture when the gas is manufactured gas or natural gas.

2. A gas burner as claimed in claim 1 wherein said regulator ring has an internal diameter, and wherein the diameter of said first aperture is substantially the same as the internal diameter of said regulator ring.

3. A gas burner as claimed in claim 1 wherein said regulator ring includes (a) a plurality of air intake apertures provided in said cylindrical side wall and extending between said end surfaces and (b) a plurality of strips separating said air intake apertures circumferentially and extending between said end surfaces, the total surface area of said strips being less than the total area of said apertures;

wherein said mounting means includes a cylindrical gas inlet passage in said burner body in which the gas nozzle and said regulator ring are received, said cylindrical gas inlet passage including a side wall having a plurality of said air inlet passages therein and a plurality of pillars which circumferentially separate said air inlet passages; and wherein said mounting means mounts said regulator ring angularly in said cylindrical gas inlet passage such that said air intake apertures of said regulator ring align with said air inlet passages.

4. A gas burner as claimed in claim 3 wherein said mounting means includes a retaining means for retaining said regulator ring in said cylindrical gas inlet passage of said burner body in a predetermined axial and angular position.

5. A gas burner as claimed in claim 4 wherein said retaining means includes a notch formed in said regulator ring and a screw which is received in said burner body adjacent said cylindrical gas inlet passage such that a head of said screw projects into said cylindrical gas inlet passage and engages said notch of said regulator ring.

6. A gas burner as claimed in claim 5 wherein said retaining means includes two said notches such that said head of said screw engages a respective one of said notches when said ring is in positioned first with said first outlet aperture as the facing aperture and then with said second outlet aperture as the facing aperture.

7. A gas burner as claimed in claim 1 wherein the gas burner is of the flat type;

wherein said burner body includes a gas inlet passage for the inflow of the gas and in which said gas inlet passage is vertical and cylindrically shaped and which shields the gas nozzle disposed therein, said gas inlet passage including an upper mouth;

further including (a) a cap covering said burner body and having an annular crown which rests on said burner body, said annular crown being provided with a plurality of flame orifices distributed circumferentially thereabout, (b) means forming an annular divergent passage for the gas/air mixture extending approximately transversely to the gas jet and provided between an annular surface of said burner body surrounding said mouth and an annular surface of said cap opposite said annular surface of said burner body, both said annular surfaces being frustoconically shaped, and (c) means forming an annular decompression chamber for receiving the gas/air mixture from said divergent passage and delivering the gas/air mixture to said flame orifices, said annular decompression chamber being provided between opposite surfaces of said cap and burner body adjacent said flame orifices;

wherein said end surfaces of said regulator ring are also frustoconic with a conicity approximately equal to that of said annular surface of said burner body; and wherein said mounting means mounts said facing one of said end surfaces of said regulator ring so as to be substantially a continuation of said annular surface of said burner body.

8. A gas burner as claimed in claim 7 wherein said gas inlet passage includes an inner bottom surface which receives the other of said end surfaces of said regulator ring opposite said facing surface, said inner bottom surface having a frustoconic shape complimentary with that of said end surfaces of said regulator ring.

* * * * *